United States Patent [19]

Kodaka et al.

[11] 4,392,886

[45] Jul. 12, 1983

[54] METHOD OF RECOVERING CO-RICH EXHAUST GAS IN REFINING OF METAL

[75] Inventors: Mikio Kodaka; Hitoshi Morishita; Hajime Bada; Fumio Sudo, all of Chiba, Japan

[73] Assignee: Kawasaki Steel Corporation, Kobe, Japan

[21] Appl. No.: 313,951

[22] PCT Filed: Feb. 27, 1981

[86] PCT No.: PCT/JP81/00039

§ 371 Date: Oct. 22, 1981

§ 102(e) Date: Oct. 22, 1981

[87] PCT Pub. No.: WO81/02429

PCT Pub. Date: Sep. 3, 1981

[30] Foreign Application Priority Data

Feb. 29, 1980 [JP] Japan ..... 55-23964

[51] Int. Cl.[3] ..... C21C 5/34; C21C 5/36

[52] U.S. Cl. ..... 75/52; 75/51; 75/53; 75/59; 75/60

[58] Field of Search ..... 75/51, 52, 53, 59, 60

[56] References Cited

U.S. PATENT DOCUMENTS 3,771,998 11/1973 Knuppel ..... 75/60

3,988,421 10/1976 Rinaldi ..... 75/60

*Primary Examiner*—P. D. Rosenberg

*Attorney, Agent, or Firm*—Balogh, Osann, Kramer, Dvorak, Genova & Traub

[57] ABSTRACT

In order to enhance the CO concentration contained in exhaust gas generated during the refining of metal and to recover the CO as an energy source, granular limestone is blown into molten iron containing at least 0.3% of carbon through a tuyere together with a refining gas, and $CO_2$ generated by the decomposition of the limestone is reacted with carbon contained in the molten iron to form CO, and the resulting CO is recovered.

7 Claims, 4 Drawing Figures k: Thermal Conductivity of Limestone h: Heat Trausfer Coeffient Between Molten Iron and Limestone

METHOD OF RECOVERING CO-RICH EXHAUST GAS IN REFINING OF METAL

TECHNICAL FIELD

The present invention relates to a method of recovering CO-rich exhaust gas in refining of metal in a furnace for refining metal, and more particularly relates to a novel method for refining iron in order to generate a large amount of CO by means of a converter provided with an exhaust gas-recovering apparatus, wherein granular limestone ($CaCO_3$) is blown into molten iron to decompose thermally the limestone and to generate $CO_2$, and the generated $CO_2$ is reacted with carbon contained in the molten iron.

BACKGROUND ART

An apparatus for recovering exhaust gas is installed in a large number of converters at present to recover exhaust gas generated from the converter during blowing. Recovered exhaust gas in converter contains a large amount of CO, and therefore the recovered exhaust gas is an important energy source in view of the recent high cost of petroluem. In order to increase the energy level in the exhaust gas to be recovered, the following various methods have hitherto been carried out.

1. The ratio of charge for recovering OG gas is increased.

2. The amount of air sucked into the duct is decreased in order to recover CO, which is generated from converter, without combustion as possible.

3. The time from the beginning of blowing to the beginning of recovering of exhaust gas, and the time from the completion of recovering of exhaust gas to the completion of blowing are made as short as possible. That is, the time for recoving exhaust gas during blowing is made long as possible. For this purpose, for example, analysis of components of exhaust gas is carried out in a shorter period of time.

However, the amount of CO gas generated from converter is limited, and further exhaust gas must be kept to a composition outside of the explosion composition in view of the safety operation. Accordingly, when these conditions are taken into consideration, the above described methods are still insufficient.

There have been proposed ideas, wherein a conventional converter-exhaust gas recovering apparatus is used not only for collecting generated gas, but also for converting the energy system and recovering the converted energy system. As one of these ideas, a method has been proposed, wherein coke or coal as a carbon source is charged into a converter and reacted with $O_2$ therein so as to be converted into CO gas, and the resulting CO gas is recovered. However, in this method, a large amount of oxygen source must be additionally added in order to convert C into CO, and further the cost of coke or coal must be taken into consideration, and therefore a high merit can not be expected.

While, in the conventional technic, limestone has been used for a long time as a solvent in a converter. Particularly, in an LD converter, limestone has been used as an inexpensive substitute for quicklime, and further as a cooling agent. However, when limestone is charged into a converter from its top, substantially all the limestone is decomposed to form CaO and $CO_2$ gas through the reaction represented by the following formula (1), and it is impossible to increase the recovered amount of CO-rich exchaust gas.

$$CaCO_3 \rightarrow CaO + CO_2 \quad \ldots (1)$$

Further, quicklime generally used at present in converter is produced according the formula (1) by roasting limestone, and $CO_2$ generated as a by-product in the reaction is discarded at present.

DISCLOSURE OF THE INVENTION

The present invention proposes an inexpensive and simple method of generating and recovering a large amount of exhaust gas having a high CO concentration by adding limestone to a furnace for refining metal, and intends to overcome the drawbacks of conventional technics by this method.

That is, the feature of the present invention lies in a method of generating a large amount of CO in refining of metal, wherein granular limestone is blown, together with a carrier gas, into a molten iron kept in a metal-refining vessel through a tuyere located beneath the bath surface at the time when the molten iron has a residual carbon concentration of at least 0.3%. In order to generate particularly large amount of CO, it is necessary that the maximum diameter $D_{max}$ of the granular limestone satisfies the following formula:

$$D_{max} \leqq (3.2\ L - 0.2)/V$$

wherein

V: blow rate of carrier gas

L: distance from tuyere to bath surface

The present invention will be explained in more detail hereinafter.

In the present invention, granular limestone is blown into molten iron kept in a furnace and having a carbon concentration of at least 0.3% through a tuyere located beneath the bath surface of the molten iron. As the results, $CO_2$ generated by the decomposition reaction of limestone is reacted with C contained in the molten iron to form CO, and substantially all the resulting CO is recovered by an apparatus for recovering exhaust gas. Moreover, C% in the molten iron is concurrently decreased, and the oxygen source necessary for decarburization can be saved. The reaction formulae in these reactions are as follows.

$$CaCO_3 \rightarrow CaO + CO_2 \quad \ldots (1)$$

$$CO_2 + C \rightarrow 2CO \quad \ldots (2)$$

In the above described reactions, when the particle size of the granular limestone to be used and the blow rate thereof are too large, the limestone reaches the bath surface of the molten iron before the limestone is completely decomposed, and $CO_2$ generated thereafter does not contribute to the reaction represented by the formula (2), and the recovered amount of CO gas and the saved amount of oxygen source are small.

FIG. 1 illustrates a relation between the particle size of limestone and the recovered percentage of CO (saved percentage of $O_2$ source). The recovered percentage of CO gas is represented by the following formula $$(A - B)/C \times 100$$

wherein

A: recovered amount of CO when limestone is blown.

B: recovered amount of CO when limestone is not blown.

C: amount of CO generated when the blown limestone is completely reacted according to the above described formulae (1) and (2).

It can be seen from FIG. 1 that, when the blow rate is 2.3 $Nm^3$/min.t and the distance from the tuyere to the bath surface (hereinafter, the distance is referred to as bath depth) is 1.5 m, a proper particle size of limestone is not larger than 2 mmϕ. FIG. 2 illustrates a relation between the particle size $D_p$ of limestone and the time t required for decomposing the limestone according to Y. Hara: Trans. ISIJ. Vol. 8, 1966, p.97–100, "Analysis for the Rate of the Thermal Decomposition of Limestone". That is, the decomposition time illustrated in FIG. 2 is necessary corresponding to each particle size. When limestone reaches the bath surface before a time t necessary for the decomposition is passed, the effect of blowing limestone decreases similarly to the case illustrated in FIG. 1. Accordingly, the upper limit value of particle size of limestone and that of blow rate of carrier gas should be determined depending upon the bath depth in order to exhibit the merit of blowing limestone in the present invention. FIG. 3 is a graph illustrating a relation between the upper limit value of blow rate of carrier gas and that of particle size of limestone in various bath depths, which relation is ascertained by experiments carried out similarly to the case of FIG. 1. It can be seen from FIG. 3 that, when the blow rate of carrier gas is lower, limestone having a larger particle size can be used, and that the blow rate $V_{max}$($Nm^3$/min.t) is represented by the following formula:

$$V_{max}=(3.2\ L-0.2)/D_{max}$$

wherein D: particle size of limestone (mmϕ). That is, the upper limit value $D_{max}$ of particle size of limestone corresponding to the upper limit value $V_{max}$ of blow rate of carrier gas is represented by the following formula:

$$D_{max}=(3.2\ L-0.2)/V_{max}$$

wherein L: distance from tuyere to bath surface (m). Accordingly, when the bath depth is represented by L and the blow rate of carrier gas is represented by V, the particle size D of limestone to be blown into molten iron must be within the range defined by the following formula:

$$D_{max}\leqq(3.2\ L-0.2)/V_{max}$$

The term "maximum particle size $D_{max}$" used herein does not mean that the limestone must not contain limestones having a particle size larger than the maximum particle size, but may contain a little amount of limestones having a larger particle size.

The time for carrying out the above described blowing of limestone will be explained hereinafter. FIG. 4 illustrates relations between the C% in a molten iron and the CO or $CO_2$ concentration in a recovered exhaust gas in a pure oxygen-bottom blowing converter. It can be seen from FIG. 4 that, when C% in a molten iron reaches 0.2–0.3%, the decarburization efficiency is noticeably decreased to decrease the CO content. Accordingly, even when limestone is blown into a molten iron having such low carbon content, the recovered amount of CO gas is small, and the saved amount of oxygen is small. Therefore, blowing of limestone into molten iron must be carried out when C% in the molten iron is at least 0.3%, in order to exhibit fully the merit of blowing of limestone.

BEST MODE OF CARRYING OUT THE INVENTION

Figure 1:
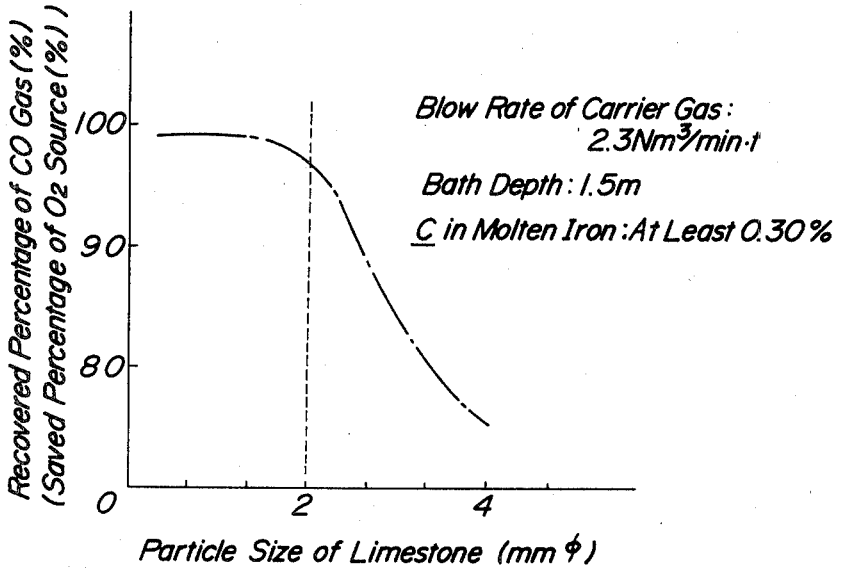
FIG. 1 is a graph illustrating a relation between the particle size of limestone and the recovered percentage of CO gas (saved percentage of oxygen source)
Figure 2:
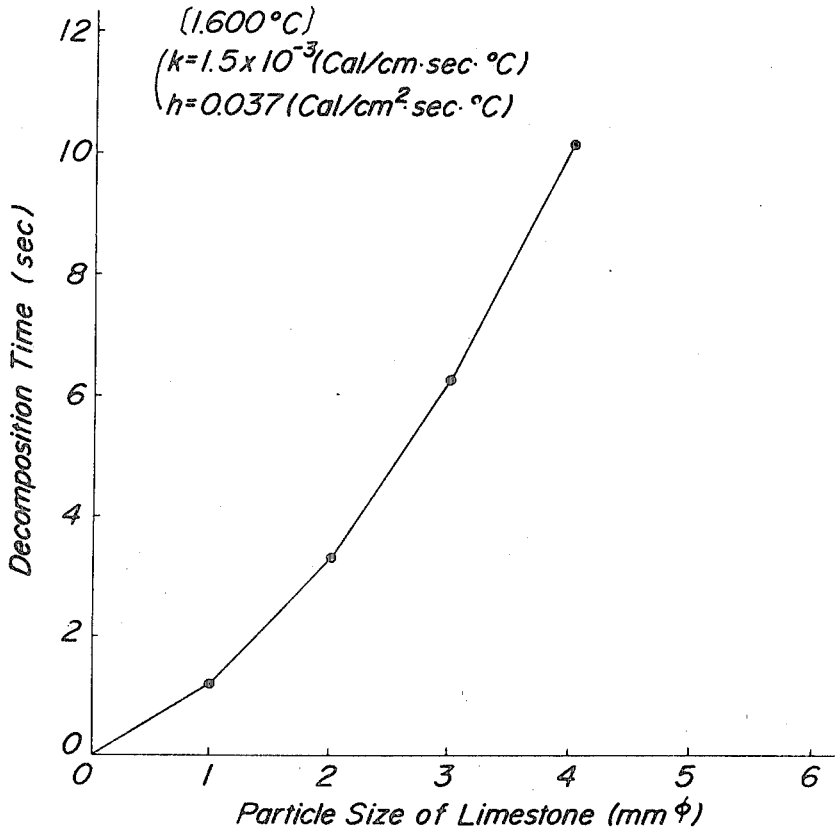
FIG. 2 is a graph illustrating a relation between the particle size of limestone and the time necessary for completing the decomposition thereof.
Figure 3:
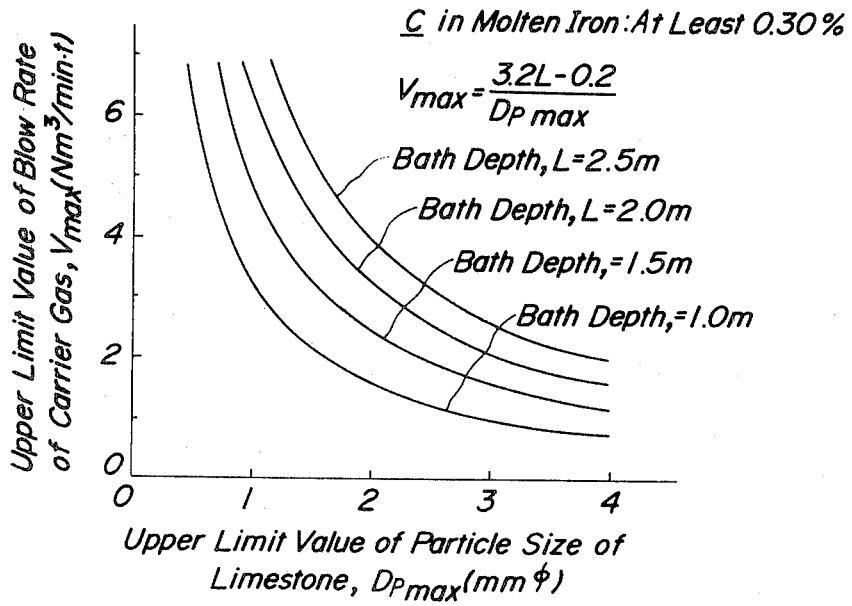
FIG. 3 is a graph illustrating a relation between the upper limit value of particle size of limestone and that of blow rate of carrier gas in various bath depths.
Figure 4:
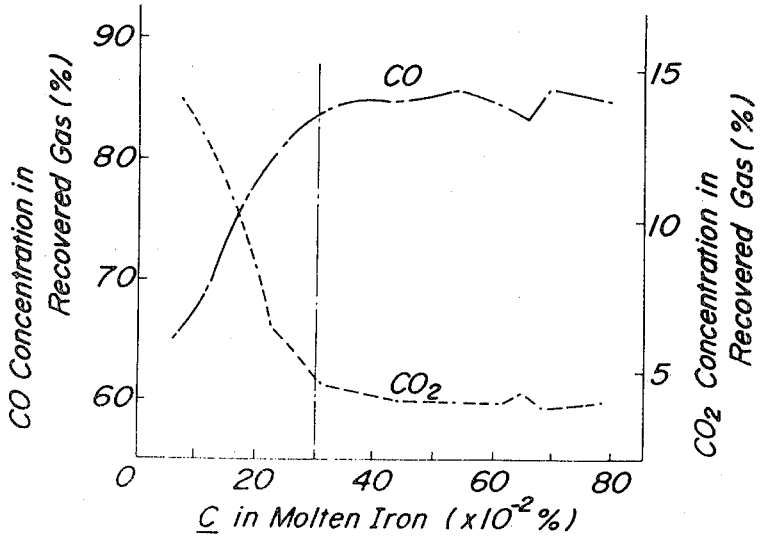
FIG. 4 is a graph illustrating relations between the C% in a molten iron and the CO or $CO_2$ concentration in a recovered exhaust gas.

Limestone was blown into an oxygen-bottom blowing converter (nominal capacity: 230t) provided with an apparatus for recovering exhaust gas at a bath depth of 1.5 m under operation during the time for recovering exhaust gas, whereby the amount of recovered energy in the form of CO gas and the amount of saved oxygen source were investigated. The obtained results are as follows.

(1) When 4 tons of granular limestone having a particle size of not larger than 0.6 mmϕ was blown into a molten iron together with 2 $NLm^3$/min.t of oxygen gas used as a carrier gas at the middle stage of a blowing shown in the following Table 1, in which middle stage the C concentration in the molten iron was decreased from 3.5% to 2.4%, the recovered energy in the form of CO gas was increased by $2{,}580\times10^3$ Kcal, and oxygen gas was able to be saved in an amount of 400 $Nm^3$.

TABLE 1

| | |
|---|---|
| Charge | Molten pig iron: 235 t, 1,350° C., C/4.2, Mn/0.40, Si/0.40, P/0.150, S/0.020 (wt. %)<br>Scrap: 5 t |
| Ist stage:<br>4 minutes from the beginning of blowing | $O_2$ blow rate: 3 $Nm^3$/min.t<br>2.5 tons of quicklime (CaO) was blown for 1.5 minutes together with $O_2$ gas as a carrier gas from the beginning of blowing. |
| IInd stage: 3 minutes (limestone-blowing stage) | $O_2$ blow rate: 2 $Nm^3$/min.t<br>C concentration in molten iron at the beginning of blowing of limestone: about 3.5%, and that at the completion thereof: about 2.4%<br>Blown amount of limestone: 4 t<br>Particle size of limestone: not larger than 0.6 mmϕ |
| IIIrd stage: 9 minutes | $O_2$ blow rate: 3 $Nm^3$/min.t (blowing of $O_2$ only)<br>1.5 tons of quicklime was blown during the last 1 minute of blowing together with $O_2$ gas as a carrier gas. |
| Completion of blowing | 1,630° C., C/0.05, Si/Trace, Mn/0.18, P/0.013, S/0.013 (wt. %) |
| Recovering period for exhaust gas | 2–15 minutes after the beginning of blowing |

(2) Similarly, when 9 tons of granular limestone having a particle size of not larger than 0.01 mmϕ was blown into a molten iron together with oxygen gas (3 $Nm^3$/min.t) at the middle stage of blowing shown in the following Table 2, in which middle stage the C concentration in the molten iron was decreased from 2.5% to 0.4%, the recovered energy in the form of CO gas was increased by $6,000\times10^3$ Kcal, and oxygen gas was able to be saved in an amount of 950 $Nm^3$.

TABLE 2

| | |
|---|---|
| Charge | Molten pig iron: 228 t, 1,370° C., C/4.3, Mn/0.30, Si/0.15, P/0.120, S/0.010 (wt %)<br>Scrap: 12 t |
| Ist stage:<br>6 minutes from the beginning of blowing | $O_2$ blow rate: 3 $Nm^3$/min.t<br>2 tons of quicklime was blown for 1.5 minutes together with $O_2$ gas as a carrier gas from the beginning of blowing. |
| IInd stage: 7 minutes (limestone-blowing stage) | $O_2$ blow rate: 3 $Nm^3$/min.t<br>C concentration in molten iron at the beginning of blowing of limestone: about 2.5%, and that at the completion thereof: about 0.4%<br>Blown amount of limestone: 9 t<br>Particle size of limestone: not larger than 0.01 mmϕ |
| IIIrd stage: 2 minutes | $O_2$ blow rate: 3 $Nm^3$/min.t (blowing of $O_2$ only) |
| Completion of blowing | 1,610° C., C/0.06, Si/Trace, Mn/0.15, P/0.012, S/0.008 (wt. %) |
| Recovering period for exhaust gas | 2–14 minutes after the beginning of blowing |

In the present invention, the molten iron must be kept to a temperature within the refining temperature range for iron, which is not lower than 1,200° C. and is free from the risk of solidification of the molten iron. However, when various factors in the converter operation are taken into consideration, the molten iron is preferred to be treated within the temperature range of from 1,300° C. to 1,700° C.

As described above, according to the present invention, CaO which is inherently necessary for dephosphorization, desulfurization and the like of molten iron in a converter, is added to the molten iron in the form of $CaCO_3$, whereby the amount of CO gas to be generated can be easily improved. Accordingly, the object of the present invention can be attained relatively easily without carrying out complicated refining processes in the conventional method. Moreover, in the present invention, coke or coal is not used, and therefore it is not necessary to add additionally oxygen source, and the operation is inexpensive. In the above described examples, limestone was blown by using oxygen gas. However, in the present invention, limestone can be blown by using inert gases, such as $N_2$, $CO_2$, argon and the like.

As the blowing tuyere, not only a double pipe, but also a single pipe can be used. As the blowing method, an injection lance which is immersed beneath the bath surface from the upper portion, may be used.

The above described explanation has been made with respect to converter, but the present invention can be carried out in other refining apparatuses provided with an apparatus for recovering exhaust gas.

INDUSTRIAL APPLICABILITY

According to the present invention, CO contained in exhaust gas generated during the refining of metal can be recovered as an energy source in a high yield.

We claim:

1. A method of recovering CO-rich exhaust gas in refining of metal, comprising blowing granular limestone together with a carrier gas into a molten iron having a carbon concentration of at least 0.3% and kept in a metal-refining vessel through a tuyere located beneath the bath surface to generate CO, and recovering the CO-containing exhaust gas in an exhaust gas-recovering apparatus.

2. A method according to claim 1, wherein the maximum diameter $D_{max}$ of the granular limestone satisfies the following formula:

$$D_{max} \leqq (3.2\ L-0.2)/V$$

wherein

V: blow rate of carrier gas

L: distance from tuyere to bath surface

3. A method according to claim 1 or 2, wherein the vessel for refining metal is a converter provided with a tuyere at a position beneath the bath surface.

4. A method according to claim 3, wherein the tuyere has a double pipe consisting of an inner pipe for blowing oxygen and an outer pipe for blowing a protecting gas.

5. A method according to claim 3, wherein the tuyere is a single pipe tuyere.

6. A method according to claim 1 or 2, wherein the carrier gas is oxygen.

7. A method according to claim 1 or 2, wherein the carrier gas is an inert gas, such as $N_2$, $CO_2$ or argon.

* * * * *